US011109737B2

(12) United States Patent
Johannes et al.

(10) Patent No.: US 11,109,737 B2
(45) Date of Patent: Sep. 7, 2021

(54) DISHWASHER

(71) Applicant: Samsung Electronics Co., Ltd., Suwon-si (KR)

(72) Inventors: Buesing Johannes, Yongin-si (KR); Soo Hyung Yoo, Suwon-si (KR); Ji Sun Yang, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 254 days.

(21) Appl. No.: 16/329,446

(22) PCT Filed: Jun. 29, 2017

(86) PCT No.: PCT/KR2017/006895
§ 371 (c)(1),
(2) Date: Feb. 28, 2019

(87) PCT Pub. No.: WO2018/043898
PCT Pub. Date: Mar. 8, 2018

(65) Prior Publication Data

US 2019/0246869 A1 Aug. 15, 2019

(30) Foreign Application Priority Data

Aug. 29, 2016 (KR) ..... 10-2016-0110111

(51) Int. Cl.
*A47L 15/42* (2006.01)
*A47L 15/14* (2006.01)
(Continued)

(52) U.S. Cl.
CPC ..... *A47L 15/4214* (2013.01); *A47L 15/14* (2013.01); *A47L 15/16* (2013.01); *A47L 15/23* (2013.01);
(Continued)

(58) Field of Classification Search
CPC ..... A47L 15/14; A47L 15/4221; A47L 15/42; A47L 15/4214; A47L 15/428;
(Continued)

(56) References Cited

U.S. PATENT DOCUMENTS 4,753,570 A * 6/1988 Jarvis ..... A47L 15/4225 137/510
5,377,707 A * 1/1995 Young, Jr. ..... A47L 15/4204 134/104.1
(Continued)

FOREIGN PATENT DOCUMENTS

CN 1400880 3/2003
DE 102010061347 6/2012
(Continued)

OTHER PUBLICATIONS

European Communication dated Jan. 9, 2020 in European Patent Application No. 17846823.7.
(Continued)

*Primary Examiner* — Benjamin L Osterhout
(74) *Attorney, Agent, or Firm* — Staas & Halsey LLP

(57) ABSTRACT

A dishwasher is provided in which tableware is capable of being washed with washing water of a high pressure by preventing the pressure of the washing water from dropping. The dishwasher includes a main body in which a washing tub is formed, a sump provided in the main body and storing washing water, a plurality of injection nozzles to inject the washing water into the washing tub, a plurality of flow passages respectively connected to the plurality of injection nozzles, and a distribution apparatus configured to selectively open and close the plurality of flow passages and communicate with the plurality of flow passages, respectively, and including rotary member having a plurality of
(Continued)

independent connection passages and a case in which the rotary member is accommodated.

15 Claims, 8 Drawing Sheets

(51) Int. Cl.
*A47L 15/23* (2006.01)
*A47L 15/16* (2006.01)

(52) U.S. Cl.
CPC ..... *A47L 15/42* (2013.01); *A47L 15/428* (2013.01); *A47L 15/4221* (2013.01); *A47L 15/4282* (2013.01); *A47L 15/4289* (2013.01)

(58) Field of Classification Search
CPC ..... A47L 15/4289; A47L 15/23; A47L 15/16; A47L 15/4282
See application file for complete search history.

(56) References Cited

U.S. PATENT DOCUMENTS

| | | | | |
|---|---|---|---|---|
| 6,491,049 | B1 | 12/2002 | Tuller et al. | |
| 2010/0139698 | A1 | 6/2010 | Gnadinger et al. | |
| 2013/0186437 | A1 | 7/2013 | Tuller et al. | |
| 2015/0129004 | A1* | 5/2015 | Lee | B05B 1/20 134/198 |
| 2015/0182096 | A1* | 7/2015 | Kim | A47L 15/4282 134/56 D |
| 2015/0182100 | A1* | 7/2015 | Park | A47L 15/4282 134/183 |
| 2016/0324396 | A1* | 11/2016 | Hong | A47L 15/4282 |

FOREIGN PATENT DOCUMENTS

| | | |
|---|---|---|
| EP | 2214546 | 8/2010 |
| EP | 2888983 | 7/2015 |
| KR | 94-5071 | 3/1994 |
| KR | 10-0457574 | 11/2004 |
| KR | 10-0457594 | 11/2004 |
| KR | 10-2015-0079382 | 7/2015 |
| KR | 10-1629053 | 6/2016 |
| WO | 03/096781 | 11/2003 |

OTHER PUBLICATIONS

International Search Report dated Sep. 22, 2017 in corresponding International Application No. PCT/KR2017/006895.
Written Opinion of the International Searching Authority dated Sep. 22, 2017 in corresponding International Application No. PCT/KR2017/006895.
Extended European Search Report dated Jun. 21, 2019 in European Patent Application No. 17846823.7.

* cited by examiner

DISHWASHER

CROSS REFERENCE TO RELATED APPLICATIONS

This application is a U.S. National Stage Application which claims the benefit under 35 U.S.C. § 371 of International Patent Application No. PCT/KR2017/006895 filed on Jun. 29, 2017, which claims foreign priority benefit under 35 U.S.C. § 119 of Korean Patent Application No. 10-2016-0110111 filed on Aug. 29, 2016, the contents of both of which are incorporated herein by reference.

TECHNICAL FIELD

The present disclosure relates to a dishwasher improved in flow passage structure.

BACKGROUND ART

A dishwasher is an apparatus that automatically cleans food waste left on tableware using a detergent and washing water.

The dishwasher includes a main body having a washing tub provided therein, a basket for receiving tableware, a sump for storing washing water, injection nozzles for injecting the washing water, and a pump for pumping the washing water in the sump and supplying the washing water to the injection nozzles.

A plurality of the baskets may be provided and may be disposed in the washing tub in a vertical direction. For example, a first basket and a second basket may be disposed to be spaced apart from each other by a predetermined distance in the vertical direction in the washing tub. The tableware may be washed while being placed in the first basket and the second basket.

A plurality of the injection nozzles for injecting washing water may be provided so that washing water may be injected on all the tableware placed in the plurality of baskets. For example, the plurality of injection nozzles may include a first injection nozzle positioned below the first basket to inject water to the first basket, a second injection nozzle positioned between the first basket and the second basket to inject water to the first basket and the second basket, and a third injection nozzle positioned above the second basket to inject water to the second basket.

The sump and the plurality of injection nozzles are connected by a flow passage, and the water stored in the sump is pumped by the pump and supplied to the flow passage. The water supplied to the flow passage may be injected to the tableware placed in the plurality of baskets through the plurality of injection nozzles.

In a case where water is injected with the plurality of injection nozzles at the same time, the water pressure may become weak and the washing force may be lowered. Accordingly, the flow passage may be provided with a distribution apparatus so that the washing water may be selectively injected through the plurality of injection nozzles.

DISCLOSURE OF INVENTION

Technical Problem

It is an aspect of the present disclosure to provide a dishwasher capable of minimizing the pressure loss of washing water injected from an injection nozzle by making the slope of a flow passage gentle.

Further, it is an aspect of the present disclosure to provide a dishwasher in which washing water may be selectively supplied to a plurality of flow passages by a distribution apparatus having a plurality of washing water outlets.

Technical Solution

In accordance with an aspect of the present disclosure, a dishwasher includes a main body in which a washing tub is formed, a sump provided in the main body and storing washing water, a plurality of injection nozzles to inject the washing water into the washing tub, a plurality of flow passages respectively connected to the plurality of injection nozzles, and a distribution apparatus configured to selectively open and close the plurality of flow passages and communicate with the plurality of flow passages, respectively, and including rotary member having a plurality of independent connection passages and a case in which the rotary member is accommodated.

The plurality of connection passages provided in the rotary member are formed such that the slope angle thereof is 90° or more.

The rotary member is rotated by receiving a driving force from a motor, and is provided such that, when at least one of the plurality of connection passages is opened, the washing water flows to a flow passage communicating with the connection passage.

The rotary member is gear-connected to the motor.

A gear portion is integrally provided at one side of the rotary member, and the rotary member is connected to the motor through a connection gear that is engaged with the gear portion.

The rotary member includes a flow passage inlet through which the washing water flows and a plurality of flow passage outlets connected to the plurality of flow passages.

The case includes an inlet corresponding to the flow passage inlet and a plurality of outlets corresponding to the plurality of flow passage outlets.

Any one of the plurality of outlets and the inlet are respectively positioned in an up and down direction of the case.

Any one outlet of the plurality of outlets is positioned at an upper portion of the case, and a flow passage extending in the up and down direction is connected to the outlet.

A rotating nozzle to inject the washing water while rotating in the washing tub is connected to the flow passage connected to the outlet.

The plurality of outlets include a first outlet and a second outlet respectively positioned in left and right directions of the case.

Fixed nozzles extending in the left and right directions are connected to the first outlet and the second outlet, respectively.

A cap member to prevent leakage of the washing water is provided between the first and second outlets and the fixed nozzles, respectively.

The rotary member is provided such that the washing water introduced through the flow passage inlet passes through at least one of the plurality of flow passage outlets.

The distribution apparatus is positioned in the rear of the sump.

In accordance with an aspect of the present disclosure, a dishwasher includes a main body in which a washing tub is formed, a sump provided in the main body and storing washing water, a rotating nozzle to inject the washing water from an upper portion of the washing tub, fixed nozzles fixed to a lower portion of the washing tub to inject the washing water forward, a distribution apparatus to inject the washing water selectively to the rotating nozzle or the fixed nozzles, a first flow passage to connect the sump and the distribution apparatus, and a second flow passage extending vertically from an upper portion of the distribution apparatus to connect the distribution apparatus and the rotating nozzle, wherein the distribution apparatus includes a case and a rotary member rotatably provided in the case, and the rotary member includes a flow passage inlet corresponding to the first flow passage, a first flow passage outlet corresponding to the second flow passage, and a second flow passage outlet corresponding to the fixed nozzle.

The rotary member further includes a first connection passage to connect the flow passage inlet and the first flow passage outlet, and a second connection passage provided independently of the first connection passage and to connect the flow passage inlet and the second flow passage outlet.

The fixed nozzles are provided on the left and right sides of the distribution apparatus, respectively, and the second connection passage is provided to extend toward the left fixed nozzle side and the right fixed nozzle side.

The rotary member includes a first cap member provided on the left fixed nozzle side and a second cap member provided on the right fixed nozzle side.

The rotary member receives the driving force of a motor to selectively open and close the first flow passage outlet and the second flow passage outlet while rotating, and the motor and the rotary member are gear-connected.

Advantageous Effects

According to the dishwasher according to an embodiment of the present disclosure, the washing efficiency of tableware can be improved because the tableware is washed by washing water having a high pressure.

Also, the amount of washing water used for washing the tableware can be reduced.

Also, the distribution of the washing water can be performed efficiently.

MODE FOR INVENTION

Hereinafter, a dishwasher according to an embodiment will be described in detail with reference to the drawings.

Figure 1:
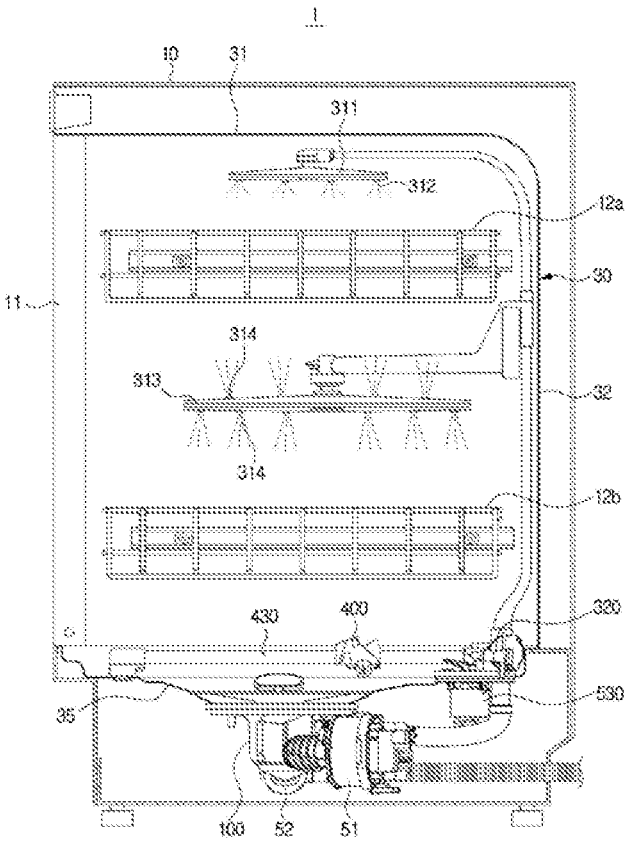
FIG. 1 is a view illustrating a configuration of a dishwasher according to an embodiment.
Figure 2:
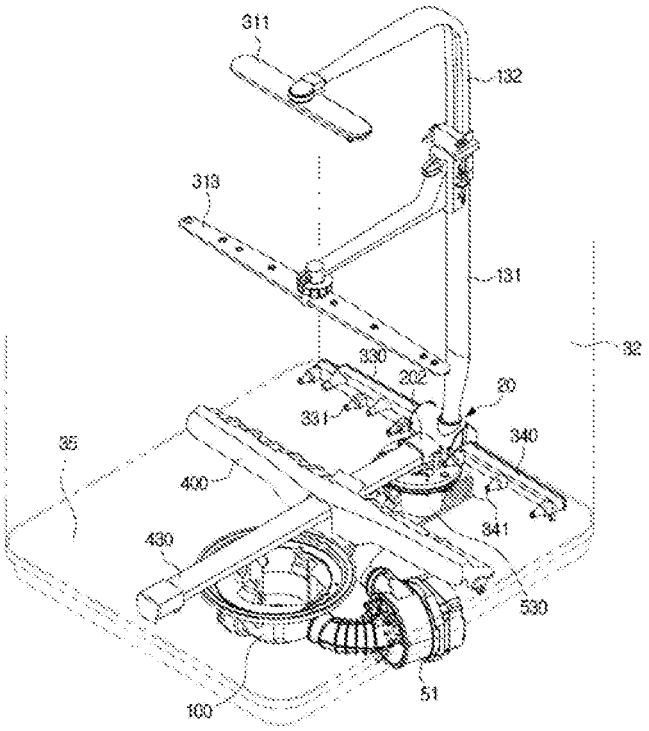
FIG. 2 is a view illustrating a flow passage configuration of a dishwasher according to an embodiment.

FIG. 1 is a view illustrating a configuration of a dishwasher according to an embodiment, and FIG. 2 is a view illustrating a flow passage configuration of a dishwasher according to an embodiment.

Referring to FIGS. 1 and 2, a dishwasher 1 according to an embodiment includes a main body 10 forming an outer appearance of the dishwasher 1, a washing tub 30 provided inside of the main body 10, baskets 12*a* and 12*b* provided inside of the washing tub 30 to accommodate tableware, injection nozzles 311, 313, and 320 to inject washing water, a sump 100 to store washing water, a circulating pump 51 to pump washing water in the sump 100 and supply the washing water to the injection nozzles 311, 313, and 320, a drain pump 52 to discharge washing water and dirt in the sump 100 to the outside of the main body 10, a vane 400 to move in the washing tub 30 and reflect washing water to the tableware, and a rail assembly 430 extending in a front-rear direction and to which the vane 400 is mounted to slide.

The washing tub 30 may be opened at the front so that tableware may be inserted and removed. The front opening of the washing tub 30 may be opened and closed by a door 11. The washing tub 30 may have a top wall 31, a rear wall 32, a left wall, a right wall and a bottom plate 35.

The baskets 12*a* and 12*b* may be wire racks made of wires so that washing water may pass without remaining. The baskets 12*a* and 12*b* may be detachably provided. The baskets 12*a* and 12*b* may include the upper basket 12*a* disposed at an upper portion of the washing tub 30 and the lower basket 12*b* disposed at a lower portion of the washing tub 30.

The injection nozzles 311, 313, and 320 may wash tableware by injecting washing water at a high pressure. The injection nozzles 311, 313, and 320 may include the upper rotating nozzle 311 provided at the upper portion of the washing tub 30, the middle rotating nozzle 313 provided at a central portion of the washing tub 30, and the fixed nozzle assembly 320 provided at the lower portion of the washing tub 30.

The upper rotating nozzle 311 is provided above the upper basket 12*a* and may inject washing water downward while being rotated by a water pressure. For this purpose, injection holes 312 may be provided at a lower end of the upper rotating nozzle 311. The upper rotating nozzle 311 may inject washing water directly toward the tableware housed in the upper basket 12*a*.

The middle rotating nozzle 313 is provided between the upper basket 12*a* and the lower basket 12*b*, and may inject washing water upward and downward while being rotated by a water pressure. For this purpose, injection holes 314 may be provided at upper and lower ends of the middle rotating nozzle 313. The middle rotating nozzle 313 may inject washing water directly toward the tableware housed in the upper basket 12*a* and the lower basket 12*b*.

The fixed nozzle assembly 320 is provided so as not to move unlike the upper and middle rotating nozzles 311 and 313, and is fixed at a side of the washing tub 30. The fixed nozzle assembly 320 is disposed adjacent to the rear wall 32 of the washing tub 30 so as to inject washing water toward the front of the washing tub 30. The washing water injected from the fixed nozzle assembly 320 may not directly be directed to the tableware.

The washing water injected from the fixed nozzle assembly 320 may be reflected by the vane 400 toward the tableware side. The fixed nozzle assembly 320 is disposed below the lower basket 12*b*, and the vane 400 may reflect the washing water injected from the fixed nozzle assembly 320 upward. That is, the washing water injected from the fixed nozzle assembly 320 may be reflected by the vane 400 toward the tableware housed in the lower basket 12*b*.

The fixed nozzle assembly 320 may have a plurality of injection holes 331 and 341 arranged at the left and right sides of the washing tub 30, respectively. The plurality of injection holes 331 and 341 may inject washing water toward the front side.

The vane 400 may extend in the left and right direction of the washing tub 30 to reflect all the washing water injected from the plurality of injection holes 331 and 341 of the fixed nozzle assembly 320. One end of the vane 400 may be provided adjacent to the left side wall of the washing tub 30 and the other end of the vane 400 may be provided adjacent to the right side wall of the washing tub 30.

The vane 400 may linearly reciprocate along the injection direction of the washing water injected from the fixed nozzle assembly 320. That is, the vane 400 may linearly reciprocate in the front-rear direction of the washing tub 30 along the rail assembly 430.

A linear injection structure including the fixed nozzle assembly 320 and the vane 400 may wash the entire area of the washing tub 30 without a blind spot. The linear spray structure is different from the case of the rotating nozzles capable of injecting the washing water only within the range of the rotating radius.

The fixed nozzle assembly 320 may include a left fixed nozzle 330 disposed on the left side of the washing tub 30 and a right fixed nozzle 340 disposed on the right side of the washing tub 30.

The upper and middle rotating nozzles 311 and 313 and the fixed nozzle assembly 320 may inject washing water independently of each other. The left fixed nozzle 330 and right fixed nozzle 340 may also inject washing water independently of each other.

The washing water injected from the left fixed nozzle 330 may be reflected by the vane 400 only to the left region of the washing tub 30, and the washing water injected from the right fixed nozzle 340 may be reflected by the vane 400 only to the right region of the washing tub 30.

The dishwasher 1 may independently wash left and right sides of the washing tub 30 by dividing the washing tub 30 into the left and right sides. Unlike the present embodiment, it is not necessarily divided into the left side and the right side, but may be further subdivided according to necessity.

The sump 100, the upper and middle rotating nozzles 311 and 313, and the fixed nozzle assembly 320 may be connected by pipe-shaped flow passages. A distribution apparatus 20 may be provided between the sump 100, the upper and middle rotating nozzles 311 and 313, and the fixed nozzle assembly 320. The distribution apparatus 20 may selectively distribute the washing water supplied from the sump 100 to the upper and middle rotating nozzles 311 and 313, and the fixed nozzle assembly 320.

A first flow passage 130 to connect the sump 100 and the distribution apparatus 20, a second flow passage 131 to connect the distribution apparatus 20 and the middle rotating nozzle 313, and a third flow passage 132 to connect the second flow passage 131 and the upper rotating nozzle 311 may be provided. The second flow passage 131 and the third flow passage 132 may be formed with a single pipe. The left fixed nozzle 330 and the right fixed nozzle 340 may be directly connected to the left and right sides of the distribution apparatus 20, respectively.

An additional distribution apparatus (not shown) may be further provided between the second flow passage 131 and the third flow passage 132. By the additional distribution apparatus positioned between the second flow passage 131 and the third flow passage 132, the washing water introduced into the second flow passage 131 may be injected through the middle rotating nozzle 313 or may move to the third flow passage 132 side. That is, the additional distribution apparatus positioned between the second flow passage 131 and the third flow passage 132 may allow the washing water introduced into the second flow passage 131 to be injected through the middle rotating nozzle 313 by closing the third flow passage 132 or may allow all the washing water introduced into the second flow passage 131 to flow to the third flow passage 132 by closing a connection portion between the second flow passage 131 and the middle rotating nozzle 313. The additional distribution apparatus may also open both the second flow passage 131 and the third flow passage 132 so that the washing water is injected from both the middle rotating nozzle 313 and the upper rotating nozzle 311.

The second flow passage 131 and the third flow passage 132 may be positioned adjacent to the rear wall 32 of the washing tub 30 so as not to be interfered by the upper and lower baskets 12*a* and 12*b*. The second flow passage 131 and the third flow passage 132 may extend adjacent to the rear wall 32 in the vertical direction.

The distribution apparatus 20 may be positioned rearward of the sump 100 in the body 10. The distribution apparatus 20 may be positioned adjacent to the rear wall 32. The distribution apparatus 20 may be positioned below the second flow passage 131 and be positioned in line with the fixed nozzle assembly 320. The distribution apparatus 20 may be positioned between the left fixed nozzle 330 and right fixed nozzle 340. Further, the distribution apparatus 20 may be positioned below the second flow passage 131 and be positioned substantially in line with the second flow passage 131.

The sump 100 is positioned at a lower portion of the bottom plate 35 and is not positioned in the washing tub 30. However, the sump 100 may be positioned at an upper portion of the bottom plate 35 and be positioned in the washing tub 30. A rail mounting portion 202 on which the rail assembly 430 for guiding the movement of the vane 400 is mounted may be provided at one side of the distribution apparatus 20. The rail assembly 430 is positioned adjacent to the bottom plate 35 and may extend in the front-rear direction in the washing tub 30.

A motor assembly 530 may be provided on the other side of the distribution apparatus 20. The motor assembly 530 may include a motor for providing a driving force to move the vane 400 backward. The rail assembly 430 is provided with a moving device that receives the driving force of the motor and moves the vane 400.

The motor assembly 530 may include a case 531 having a space in which a motor is accommodated, a cover 532 covering one side of the case 531. An upper portion of the case 531 may be opened, and a cover 532 may be provided to cover the opened portion. The distribution apparatus 20 may be mounted on the cover 532 side. A case 21 of the distribution apparatus 20 may be integrally provided with the cover 532.

The distribution apparatus 20 receives a driving force from a motor 534 and may open at least one of the left fixed nozzle 330, the right fixed nozzle 340, and the second flow passage 131. The water supplied from the sump 100 may be injected through the fixed nozzle assembly 320 by the distribution apparatus 20 or may be injected through the middle rotating nozzle 313 or the upper rotating nozzle 311. Further, only one of the left fixed nozzle 330 and the right fixed nozzle 340 may be opened by the distribution apparatus 20. Further, the washing water may be injected from either the left fixed nozzle 330 or the right fixed nozzle 340 by the distribution apparatus 20 or may be injected from both the left fixed nozzle 330 and the right fixed nozzle 340.

Hereinafter, the process, flow passage structure, fixed nozzle assembly structure, and washing water distribution structure of the dishwasher according to an embodiment of the present disclosure will be described.

The dishwasher 1 may have a water supply process, a washing process, a drainage process, and a drying process.

In the water supply process, washing water may be supplied into the washing tub 30 through a water supply pipe (not shown). The washing water supplied to the washing tub 30 flows by the gradient of the bottom plate 35 of the washing tub 30 and may be stored in the sump 100 provided at the lower portion of the washing tub 30.

In the washing process, the circulating pump 51 may be activated to pump the washing water in the sump 100. The washing water pumped by the circulating pump 51 may be distributed to the upper and middle rotating nozzles 311 and 313, the left fixed nozzle 330 and the right fixed nozzle 340 through the distribution apparatus 20. The washing water may be injected from the upper and middle rotating nozzles 311 and 313, and the fixed nozzle assembly 320 at a high pressure by the pumping force of the circulating pump 51, so that the tableware may be washed.

The upper rotating nozzle 311 and the middle rotating nozzle 313 may receive the washing water through the second flow passage 131 or the third flow passage 132. The washing water introduced into the second flow passage 131 by the distribution apparatus 20 may be introduced into the middle rotating nozzle 313 side by the additional distribution apparatus positioned at the second flow passage 131 side or be introduced into the upper rotating nozzle 311 side through the third flow passage 132. The washing water introduced into the second flow passage 131 may also be injected through both the middle rotating nozzle 313 and the upper rotating nozzle 311.

The distribution apparatus 20 may be regulated to inject the washing water through both the left fixed nozzle 330 and the right fixed nozzle 340 of the fixed nozzle assembly 320 or to inject the washing water through either the left fixed nozzle 330 or the right fixed nozzle 340.

The distribution apparatus 20 may open at least one of the fixed nozzle assembly 320 and the second flow passage 131. According to the operation of the distribution apparatus 20, the washing water pumped from the sump 100 may be introduced into only the fixed nozzle assembly 320 side, may be introduced into only the second flow passage 131 side, or may be introduced into both the fixed nozzle assembly 320 side and the second flow passage 131 side.

The distribution apparatus 20 may be provided to have more distribution modes than the example described above.

The washing water that has been injected from the upper and middle rotating nozzles 311 and 313, and the fixed nozzle assembly 320 may hit the tableware, remove dirt adhering to the tableware, drop with the dirt, and be stored in the sump 100 again. The circulating pump 51 pumps and circulates the wash water stored in the sump 100 again. During the washing process, the circulating pump 51 may be operated and stopped several times. In this process, the dirt dropped into the sump 100 together with the washing water is collected by a filter mounted on the sump 100 and remains in the sump 100 without circulating through the upper and middle rotating nozzles 311 and 313, and the fixed nozzle assembly 320.

In the drainage process, the drain pump 52 is activated to drain the washing water together with the dirt remaining in the sump 100 to the outside of the main body 10.

In the drying process, a heater (not shown) mounted on the washing tub 30 is activated to dry the tableware.

Figure 3:
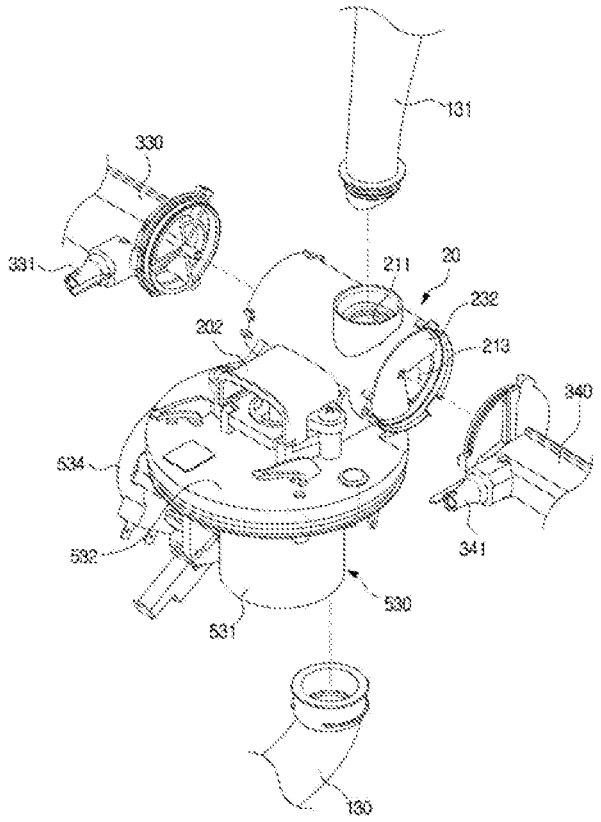
FIG. 3 is a perspective view illustrating a distribution apparatus according to an embodiment.
Figure 4:
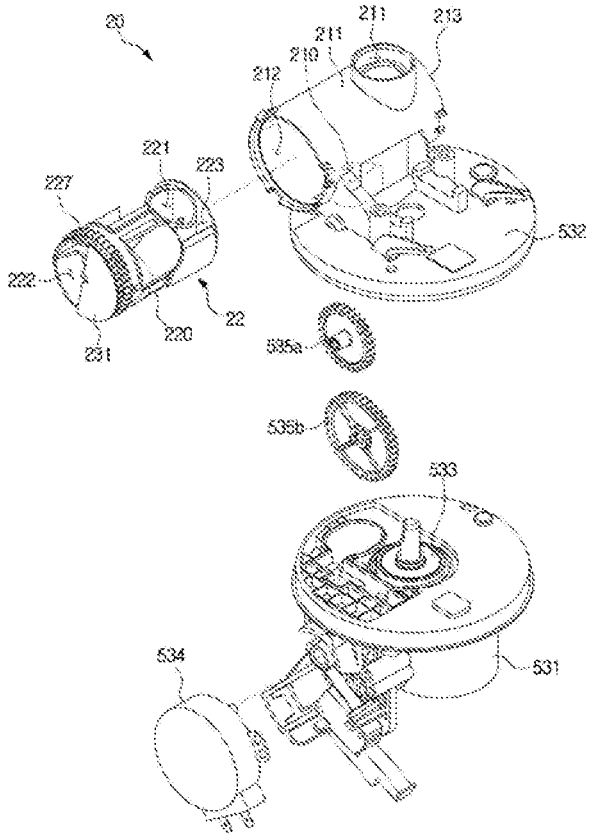
FIG. 4 is an exploded perspective view illustrating a distribution apparatus according to an embodiment.
Figure 5:
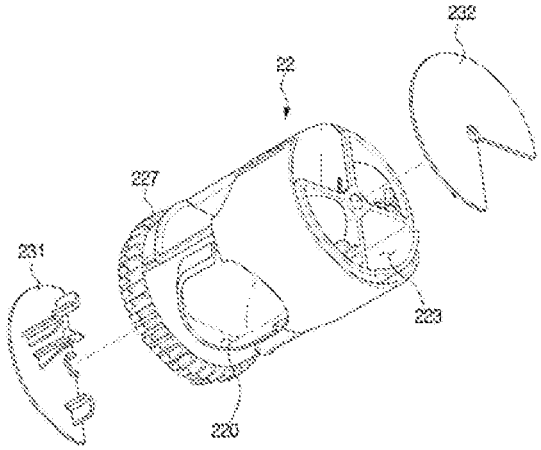
FIG. 5 is a perspective view illustrating a rotary member included in a distribution apparatus according to an embodiment.

FIG. 3 is a perspective view illustrating a distribution apparatus according to an embodiment, FIG. 4 is an exploded perspective view illustrating a distribution apparatus according to an embodiment, and FIG. 5 is a perspective view illustrating a rotary member included in a distribution apparatus according to an embodiment.

Referring to FIGS. 3 to 5, the distribution apparatus 20 according to an embodiment includes the case 21, and a rotary member 22 rotatably provided in the case 21. The rotary member 22 may be rotated by receiving a driving force from the motor 534. The case 21 and the rotary member 22 may be provided in a substantially cylindrical shape. However, the shape of the case 21 and the rotary member 22 is not limited to the cylindrical shape.

The case 21 includes an inlet 210 connected to the first flow passage 130 connected to the sump 100 side. The washing water in the sump 100 may be pumped by the circulating pump 51 and supplied to the case 21 through the inlet 210. The case 21 may be further provided with a first outlet 211 corresponding to the second flow passage 131, a second outlet 212 corresponding to the left fixed nozzle 330 and a third outlet 213 corresponding to the right fixed nozzle 340.

The inlet 210 and the first outlet 211 may be positioned to face each other on one side and the other side of the case 21. The second outlet 212 and the third outlet 213 may be positioned on a straight line extending in the left and right direction formed by the left fixed nozzle 330 and the right fixed nozzle 340.

In a case where the case 21 is provided in a cylindrical shape, the inlet 210 and the first outlet 211 may be provided on a side surface of the case 21 formed as a curved surface. The second outlet 212 and the third outlet 213 may be respectively provided on the upper surface and the lower surface of the case 21 provided as a plane.

The rotary member 22 may be rotatably housed in the case 21. A flow passage inlet 220 corresponding to the inlet 210 provided in the case 21 may be provided at one side of the rotary member 22.

The rotary member 22 may be provided with a first flow passage outlet 221 at a position opposite to the flow passage inlet 220. The first flow passage outlet 221 may correspond to the first outlet 211 provided in the case 21. The flow passage inlet 220 and the first flow passage outlet 221 are provided to communicate with each other. The flow passage through which the flow passage inlet 220 and the first flow passage outlet 221 are connected may be referred to as a first connection passage 224.

The flow passage inlet 220 provided in the rotary member 22 and the inlet 210 provided in the case 21 may be formed to be different in the size and shape. In addition, the first flow passage outlet 221 provided in the rotary member 22 and the first outlet 211 formed in the case 21 may be formed to be different in at least one of the size, the shape and the forming position.

Therefore, according to the arrangement of the rotary member 22 in the case 21, even if the flow passage inlet 220 provided in the rotary member 22 and the inlet 210 provided in the case 21 are communicated with each other, the washing water introduced into the rotary member 22 through the inlet 210 and the flow passage inlet 220 may pass through or may not pass through the first outlet 211 and the first flow passage outlet 221.

The rotary member 22 may be provided with a second flow passage outlet 222 and a third flow passage outlet 223 corresponding to the second outlet 212 and the third outlet 213, respectively. The second flow passage outlet 222 and the third flow passage outlet 223 may be positioned to face each other.

The flow passage inlet 220 and the second flow passage outlet 222 may be communicated by a second connection passage 225. The flow passage inlet 220 and the third flow passage outlet 223 may be communicated by a third connection passage 226.

The first connection passage 224, the second connection passage 225, and the third connection passage 226 may not be connected to each other but may be provided as separate independent flow passages. For example, the first connection passage 224 may be provided to extend to an upper portion where the first flow passage outlet 221 is positioned, the second connection passage 225 may be provided to extend to the left where the left fixed nozzle 330 is positioned, and the third connection passage 226 may be provided to extend to the right where the right fixed nozzle 340 is positioned.

In a case where the rotary member 22 is provided in a cylindrical shape, the flow passage inlet 220 and the first flow passage outlet 221 may be provided on a side surface of the rotary member 22 formed as a curved surface. The second flow passage outlet 222 and the third flow passage outlet 223 may be provided at positions corresponding to the upper and lower surfaces of the cylinder, respectively.

The first flow passage outlet 222 and the third flow passage outlet 223 are positioned to face each other and may have different sizes or shapes. Therefore, according to the arrangement of the rotary member 22, when the washing water introduced into the distribution apparatus 20 is discharged to the left fixed nozzle 330 side through the first flow passage outlet 222 provided in the rotary member 22 and the first outlet 212 provided in the case 21, the washing water may be discharged simultaneously to the right fixed nozzle 330 side through the second flow passage outlet 223 and the first outlet 213, or may not be discharged to the right fixed nozzle 330 side.

As such, the rotary member 22 provided as a single member may be connected to a plurality of flow passages by the plurality of internal connection passages 224, 225, and 226 provided independently of each other. The single rotary member 22 may control to flow the washing water selectively to at least some of the plurality of flow passages. The flow passage structure of the dishwasher 1 may be simplified by opening and closing the flow passages by means of the single rotary member 22.

In addition, the rotary member 22 may guide washing water by providing flow passages inside the rotary member 22, which may communicate with the respective flow passages. The connection passages 224, 225, and 226 formed in the rotary member 22 may be formed to have no sharp slope. The connection passages 224, 225 and 226, the second flow passage 131 and the fixed nozzle assembly 320 are connected by the gentle connection passages 224, 225 and 226 to prevent the water pressure of the washing water pumped by the circulating pump 51 from dropping.

Cap members 222 and 223 may be mounted on opposite side surfaces of the rotary member 22. The cap members 222 and 223 may include a first cap member 231 provided on one side of which the second flow passage outlet 222 is formed, a second cap member 232 provided on the other side where the third flow passage outlet 223 is formed. The first cap member 231 and the second cap member 232 are formed in a thin plate shape and may be brought into close contact with the second flow passage outlet 222 side or the third flow passage outlet 223 side by water pressure. Water leak at the connection portion between the distribution apparatus 20 and the fixed nozzle assembly 320 may be prevented by the first and second cap members 222 and 223.

Although the cap members 222 and 223 provided on the opposite side surfaces of the rotary member 22 have been described above, the cap member may be provided both between the flow passage outlet provided in the rotary member 22 and the flow passage connected to the rotary member 22.

A driving force transmitting portion for receiving the driving force of the motor 534 may be provided on one side of the rotary member 22. For example, the driving force transmitting portion may be a gear portion 227 provided on one side of the rotary member 22. Hereinafter, an embodiment in which the driving force transmitting portion is the gear portion 227 will be described.

Figure 6:
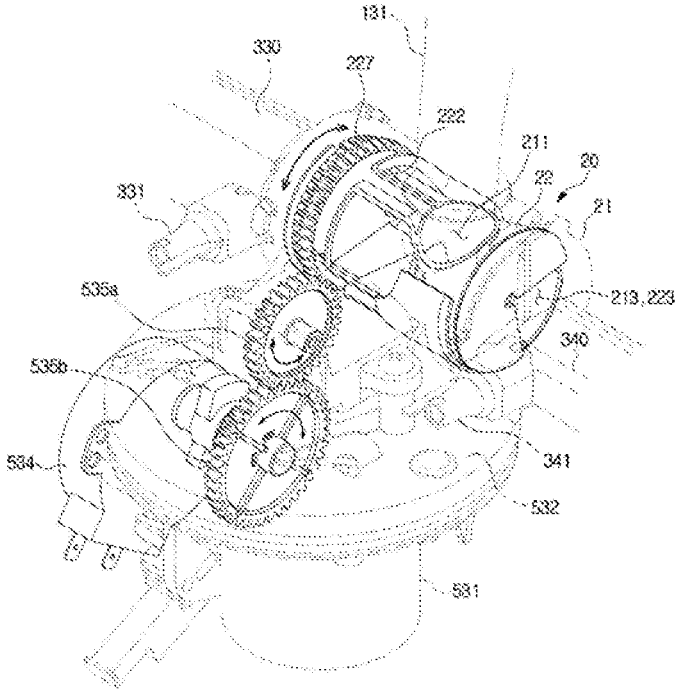
FIG. 6 is a view illustrating the inside of a distribution apparatus according to an embodiment.

FIG. 6 is a view illustrating the inside of a distribution apparatus according to an embodiment.

Referring to FIG. 6, the distribution apparatus 20 according to an embodiment may receive the driving force of the motor 534 and rotate the rotary member 22 in the case 21 to selectively open and close the flow passages. The rotary member 22 and the motor 534 may be gear-connected. That is, the driving force of the motor 534 may be transmitted to the rotary member 22 through a plurality of gears connected to the motor 534.

For example, the gear portion 227 may be provided on one side of the rotary member 22. A driving gear **535*b* may be connected to a rotation shaft (not shown) of the motor 534, and a connection gear 535*a* may be engaged with the driving gear 535*b*. The connection gear 535*a* may be engaged with the gear portion 227. The driving force of the motor 534 may be transmitted to the rotary member 22 through the driving gear 535*b*, the connection gear 535*a*, and the gear portion 227. The gear portion 227 may be provided integrally with the rotary member 22**.

The connection gear 535 may be rotated in the clockwise or counterclockwise direction by the driving force of the motor 534. The rotary member 22 may be rotated in the clockwise or counterclockwise direction by receiving the driving force through the connection gear 535 and the gear portion 227 engaged with the connection gear 535. As such, the rotary member 22 may selectively open and close the second flow passage 131, the left fixed nozzle 330, and the right fixed nozzle 340 while rotating clockwise or counterclockwise.

The driving force of the motor 534 may be more accurately transmitted to the rotary member 22 by the gear connection. The driving force of the motor 534 may be more accurately transmitted by the gear connection than in the case of the other connection structure such as a pulley and a belt structure. By receiving the driving force by the gear connection, the rotation angle, the rotation speed, and the like of the rotary member 22 may be controlled according to preset information. The rotary member 22 may accurately perform opening and closing operations of the flow passages so as to open only the selected flow passage in accordance with the preset information.

Figure 7:
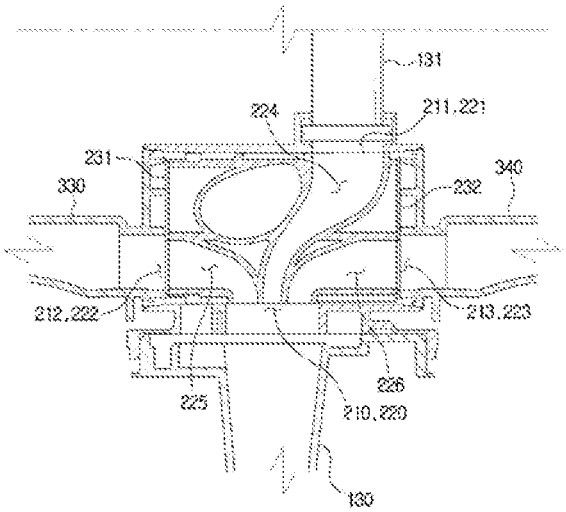
FIG. 7 is a view illustrating a distribution apparatus according to an embodiment and flow passages connected to the distribution apparatus.

FIG. 7 is a view illustrating a distribution apparatus according to an embodiment and flow passages connected to the distribution apparatus.

Referring to FIG. 7, a plurality of flow passages formed in a distribution apparatus according to an embodiment may be provided to have a gentle slope. Specifically, an open flow passage among the connection passages 224, 225, and 226 of the rotary member 22 may be provided so as not to have a sharp slope. The washing water supplied from the sump 100 may pass through the connection passage having a gentle slope to flow to at least one of the second flow passage 131, the left fixed nozzle 330, and the right fixed nozzle 340.

Specifically, in a case where the first flow passage outlet 221 is opened so that the washing water flows to the second flow passage 131 side, the first connection passage 224 connecting the flow passage inlet 220 and the first flow passage outlet 221 of the rotary member 22 may be provided to extend substantially in a straight line without a sharp slope.

In addition, the second connection passage 225 connecting the flow passage inlet 220 and the second flow passage outlet 222, and the third connection passage 226 connecting the flow passage inlet 220 and the third flow passage outlet 223 may be provided to have a gentle slope when the second flow passage outlet 222 and the third flow passage outlet 223 are opened. Specifically, the inflow direction of the washing water through the first flow passage 130 and the moving direction of the washing water flowing along the second connection passage 225 or the third connection passage 226 may be provided so as not to be less than 90°.

As such, the pressure of the washing water may be prevented from being lost because the washing water passes through the flow passage having a gentle slope when passing through the rotary member 22. The pressure loss of the washing water is minimized, and thus the washing efficiency of the tableware may be prevented from being lowered. In the case of the present disclosure, since washing of the tableware is performed by washing water injected with a strong water pressure, less energy and less water may be used for the same washing effect, which is economical.

Figure 8:
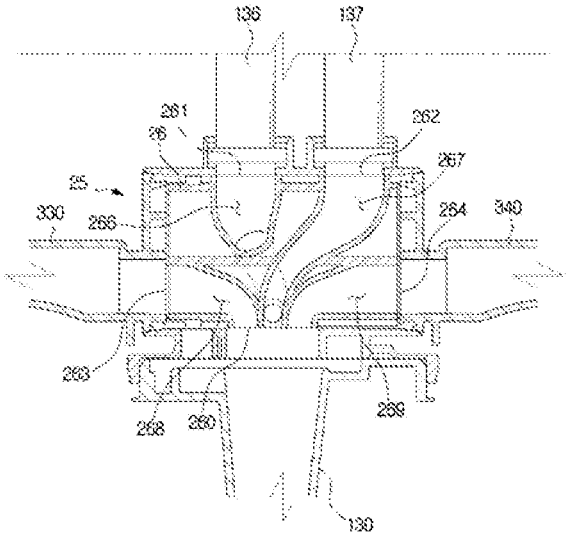
FIG. 8 is a view illustrating a distribution apparatus according to another embodiment and flow passages connected to the distribution apparatus.

FIG. 8 is a view illustrating a distribution apparatus according to another embodiment and flow passages connected to the distribution apparatus.

Referring to FIG. 8, a fourth flow passage 136 connected to the middle rotating nozzle 313 and a fifth flow passage 137 connected to the upper rotating nozzle 311 may be connected to a distribution apparatus 25 according to another embodiment. The fifth flow passage 137 for supplying washing water to the upper rotating nozzle 311 is separately provided, and thus the distribution apparatus that is provided on the second flow passage 131 disclosed in FIGS. 1 to 7 to open and close the middle rotating nozzle 313 or the upper rotating nozzle 311 is not separately provided.

The distribution apparatus 25 includes a rotary member 26 provided to be rotatable by receiving the driving force of a motor, and a case 27 accommodating the rotary member 26. Similar to the embodiment disclosed in FIGS. 1 to 7, the distribution apparatus 25 may be connected to the sump 100 by the first flow passage 130 and the left fixed nozzle 330 and the right fixed nozzle 340 may be connected to the left and right sides of the distribution apparatus 25, respectively.

A flow passage inlet 260 that is communicated with the first flow passage 130 is provided on the rotary member 26. Also, a first flow passage outlet 261 that may be connected to the fourth flow passage 136, a second flow passage outlet 262 that may be connected to the fifth flow passage 137, a third flow passage outlet 263 that may be connected to the left fixed nozzle 330, and a fourth flow passage outlet 264 that may be connected to the right fixed nozzle 340 are provided on the rotary member 26.

A first connection passage 266 to connect the flow passage inlet 260 and the first flow passage outlet 261, a second connection passage 267 to connect the flow passage inlet 260 and the second flow passage outlet 262, a third connection passage 268 to connect the flow passage inlet 260 and the third flow passage outlet 263, and a fourth connection passage 269 to connect the flow passage inlet 260 and the fourth flow passage outlet 264 are provided inside the rotary member 26.

The first connection passage 266, the second connection passage 267, the third connection passage 268, and the fourth connection passage 269 may be independently provided.

The rotary member 260 may be rotated so that the flow passage outlets 261, 262, 263, and 264 may be selectively opened and closed. The rotary member 260 may be rotated by receiving a driving force from the motor. The motor and the rotary member 260 may be gear-connected. The connection structure between the motor 534 and the rotary member 220 disclosed in FIGS. 1 to 7 may be similarly applied to the connection between the motor and the rotary member 260.

According to the present disclosure, a plurality of flow passages may be selectively opened and closed by independently providing the plurality of flow passages inside the rotary member. The distribution apparatus is positioned in a rear portion of the dishwasher, and the connection passages formed inside the rotary member are also provided to have a gentle slope. Thus, the upper rotating nozzle, the middle rotating nozzle, and the left and right fixed nozzles may be connected by the flow passages having a gentle slope. The pressure loss of washing water may be prevented by allowing the washing water to flow through the flow passages having a gentle slope. Therefore, the energy and water required for the same washing effect may be saved.

The rotating operation of the rotary member may be accurately performed because the rotary member receives the driving force of the motor by a gear connection. Therefore, the opening and closing operation of the flow passages may be accurately performed.

Although in the above description, the one or two flow passages connected to the distribution apparatus are connected to the fixed nozzle assembly and the rotating nozzles, the number of flow passages that may be connected to the distribution apparatus is not limited to that described above. However, the connection passages in the distribution apparatus and the flow passages connected to the distribution apparatus may be formed so as not to have a sharp slope so that the water pressure does not decrease while the washing water passes through the distribution apparatus. To this end, the dispensing apparatus may be positioned at a lower portion of the flow passages that is positioned in the rear of the washing tub and connected to the rotating nozzles.

The rotary member rotatably provided in the distribution apparatus may be connected to the motor by the gear connection to be accurately driven according to preset information. A plurality of flow passage outlets are formed in the rotary member so that the plurality of flow passages may be selectively opened and closed.

The invention claimed is:

1. A dishwasher comprising:

a main body in which a washing tub is formed;

a sump provided in the main body and storing washing water;

a plurality of injection nozzles to inject the washing water into the washing tub;

a plurality of flow passages respectively connected to the plurality of injection nozzles; and a distribution apparatus configured to selectively open and close the plurality of flow passages, and including a rotary member having a plurality of independent connection passages communicating with the plurality of flow passages, respectively, and a case in which the rotary member is accommodated, wherein each of the plurality of independent connection passages extends in different directions.

2. The dishwasher according to claim 1, wherein:

the plurality of connection passages provided in the rotary member are formed such that the slope angle thereof is 90° or more.

3. The dishwasher according to claim 1, wherein:

the rotary member is rotated by receiving a driving force from a motor, and is provided such that, when at least one of the plurality of connection passages is opened, the washing water flows to a flow passage communicating with the connection passage.

4. The dishwasher according to claim 3, wherein:

the rotary member is gear-connected to the motor.

5. The dishwasher according to claim 4, wherein:

a gear portion is integrally provided at one side of the rotary member, and the rotary member is connected to the motor through a connection gear that is engaged with the gear portion.

6. The dishwasher according to claim 1, wherein:

the rotary member includes a flow passage inlet through which the washing water flows and a plurality of flow passage outlets connected to the plurality of flow passages.

7. The dishwasher according to claim 6, wherein:

the case includes an inlet corresponding to the flow passage inlet and a plurality of outlets corresponding to the plurality of flow passage outlets.

8. The dishwasher according to claim 7, wherein:

any one of the plurality of outlets and the inlet are respectively positioned in an up and down direction of the case.

9. The dishwasher according to claim 8, wherein:

any one outlet of the plurality of outlets is positioned at an upper portion of the case, and a flow passage extending in the up and down direction is connected to the outlet.

10. The dishwasher according to claim 9, wherein:

a rotating nozzle to inject the washing water while rotating in the washing tub is connected to the flow passage connected to the outlet.

11. The dishwasher according to claim 7, wherein:

the plurality of outlets include a first outlet and a second outlet respectively positioned in left and right directions of the case.

12. The dishwasher according to claim 11, wherein:

fixed nozzles extending in the left and right directions are connected to the first outlet and the second outlet, respectively.

13. The dishwasher according to claim 12, wherein:

a cap member to prevent leakage of the washing water is provided between the first and second outlets and the fixed nozzles, respectively.

14. The dishwasher according to claim 7, wherein:

the rotary member is provided such that the washing water introduced through the flow passage inlet passes through at least one of the plurality of flow passage outlets.

15. The dishwasher according to claim 1, wherein:

the distribution apparatus is positioned in the rear of the sump.

* * * * *